US008555650B2

(12) United States Patent
Kashihara et al.

(10) Patent No.: US 8,555,650 B2
(45) Date of Patent: Oct. 15, 2013

(54) COMBUSTION DEVICE FOR ANNULAR INJECTION OF A PREMIXED GAS AND METHOD FOR CONTROLLING THE COMBUSTION DEVICE

(75) Inventors: Hiroyuki Kashihara, Akashi (JP); Yasushi Yoshino, Akashi (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 420 days.

(21) Appl. No.: 12/993,233

(22) PCT Filed: May 22, 2009

(86) PCT No.: PCT/JP2009/002274
§ 371 (c)(1),
(2), (4) Date: Nov. 30, 2010

(87) PCT Pub. No.: WO2009/142026
PCT Pub. Date: Nov. 26, 2009

(65) Prior Publication Data

US 2011/0094233 A1 Apr. 28, 2011

(30) Foreign Application Priority Data

May 23, 2008 (JP) ..... 2008-136068

(51) Int. Cl.
*F02G 1/00* (2006.01)
*F02G 3/00* (2006.01)

(52) U.S. Cl.
USPC ..... 60/748; 60/737; 60/746; 239/399

(58) Field of Classification Search
USPC ..... 60/748, 737, 746, 747, 804, 740, 742, 60/738; 239/399, 400, 401, 402, 403, 404, 239/405, 406
See application file for complete search history.

(56) References Cited

U.S. PATENT DOCUMENTS 5,062,792 A 11/1991 Maghon
RE33,896 E 4/1992 Maghon et al.
(Continued)

FOREIGN PATENT DOCUMENTS

DE 3606625 A1 9/1986
DE 4110507 A1 10/1992
(Continued)

OTHER PUBLICATIONS

Russian Federal Service for Intellectual Property, Decision on Grant of RU2010152687, Jun. 26, 2012, Russia, 9 pages.
(Continued)

*Primary Examiner* — William H Rodriguez
(74) *Attorney, Agent, or Firm* — Alleman Hall McCoy Russell & Tuttle, LLP

(57) ABSTRACT

A combustion device includes: a combustion liner in which a combustion chamber is formed; a main burner provided at a top portion of the combustion liner and including a premix passage configured to annularly inject a pre-mixed gas of a fuel and air into the combustion chamber and a radial swirler configured to introduce the fuel and the air to the premix passage in a radially inward direction; and a fuel injection pipe configured to inject the fuel to the radial swirler from an entrance side of the radial swirler, and the radial swirler is divided into a plurality of swirler stages by dividing plates in an axial direction.

7 Claims, 6 Drawing Sheets

(56) References Cited

U.S. PATENT DOCUMENTS

| | | | | |
|---|---|---|---|---|
| 5,319,935 | A * | 6/1994 | Toon et al. | 60/733 |
| 5,394,688 | A * | 3/1995 | Amos | 60/39.23 |
| 5,408,825 | A * | 4/1995 | Foss et al. | 60/39.463 |
| 5,647,215 | A * | 7/1997 | Sharifi et al. | 60/737 |
| 6,109,038 | A * | 8/2000 | Sharifi et al. | 60/737 |
| 6,253,555 | B1 * | 7/2001 | Willis | 60/737 |
| 6,513,334 | B2 * | 2/2003 | Varney | 60/776 |
| 6,691,515 | B2 * | 2/2004 | Verdouw et al. | 60/737 |
| 8,033,112 | B2 * | 10/2011 | Milosavljevic et al. | 60/737 |
| 8,375,721 | B2 * | 2/2013 | Wilbraham | 60/748 |

FOREIGN PATENT DOCUMENTS

| | | | |
|---|---|---|---|
| EP | 0 870 989 | A2 | 10/1998 |
| GB | 2272756 | A | 5/1994 |
| JP | 2-100060 | U | 8/1990 |
| JP | 6-502240 | | 3/1994 |
| JP | 07-233945 | | 9/1995 |
| JP | 08-028871 | | 2/1996 |
| JP | 08-210641 | | 8/1996 |
| JP | 2002-323221 | A | 11/2002 |
| JP | 2006-507466 | A | 3/2006 |
| JP | 2006-144759 | A | 6/2006 |
| RU | 527933 | C | 2/1995 |
| RU | 2145402 | C1 | 2/2000 |
| WO | 9207221 | | 4/1992 |
| WO | 2004025183 | A2 | 3/2004 |

OTHER PUBLICATIONS

ISA Japanese Patent Office, International Search Report of PCT/JP2009/002274, Aug. 18, 2009, 2 pages.

Russian Patent Office, Office Action of RU2010152687, Mar. 15, 2012, 7 pages.

* cited by examiner

COMBUSTION DEVICE FOR ANNULAR INJECTION OF A PREMIXED GAS AND METHOD FOR CONTROLLING THE COMBUSTION DEVICE

CROSS-REFERENCE TO RELATED APPLICATION

This application claims priority to and the benefit of Japanese Patent Application No. 2008-136068, filed in Japan Patent Office on May 23, 2008, the entire disclosure of which is incorporated herein by reference.

TECHNICAL FIELD

The present invention relates to a combustion device used for a device, such as a gas turbine engine or a boiler, which requires supply of a high-temperature gas and a method for controlling a radial fuel concentration of especially a pre-mixed gas in the combustion device.

BACKGROUND ART

Out of consideration for environmental preservation, strict environmental standards for the composition of an exhaust gas discharged by combustion in the gas turbine engine are set up, and toxic substances, such as nitrogen oxide (hereinafter referred to as "NOx"), need to be reduced. In contrast, in the gas turbine engines for large-scale ground equipment and aircraft, a pressure ratio tends to be set high in order to reduce fuel consumption and increase an output, and this increases the temperature and pressure at an entrance of the combustion device. Since the temperature of the combustion easily increases by the increase in the temperature at the entrance of the combustion device, it is anticipated that NOx may rather increase.

Here, a combustion system adopting a lean premix combustion system which effectively reduces a NOx generation amount has been proposed in recent years. For example, a combined combustion system obtained by combining the lean premix combustion system and a diffusion combustion system has been proposed (see Japanese Laid-Open Patent Application Publication No. 8-28871 and Japanese Laid-Open Patent Application Publication No. 8-210641). In the lean premix combustion system, the air and the fuel are pre-mixed and combusted as an air-fuel mixture whose fuel concentration is uniformized. Therefore, a combustion region where a flame temperature is locally high does not exist. In addition, the flame temperature can be wholly lowered by the dilution of the fuel. On this account, the NOx generation amount can be effectively reduced. In contrast, blow-off tends to occur at the time of low-load combustion. Moreover, since the diffusion combustion system combusts the fuel and the air while diffusing and mixing the fuel and the air, the blow-off is unlikely to occur even at the time of the low load, and a flame holding performance is excellent. In contrast, the diffusion combustion system has a problem with the reduction in the NOx generation amount. Therefore, in accordance with the combined combustion system, the reduction in the NOx generation amount can be achieved by the premix combustion at the time of high load while securing the combustion stability by the diffusion combustion at the time of start-up and low load.

For example, as shown in FIG. 6, the combustion device of the conventional combined combustion system adopts a swirl-type burner unit 85 configured such that a premix combustion burner (main burner) 84 including a radial swirler 83 having a fixed swirl vane is provided so as to surround an outer side of a diffusion combustion burner (pilot burner) 82 provided at a top portion 81*a* of a combustion liner 81 of a combustion device 80 and further configured to inject a pre-mixed gas P as a swirl flow into a combustion chamber.

SUMMARY OF INVENTION

Technical Problem

In order to enhance the flame holding in the conventional combustion device 80 using the swirl-type main burner 84 including the radial swirler 83, the conventional combustion device 80 is set such that the swirling of the pre-mixed gas is enhanced to enhance a reverse flow R of the pre-mixed gas. In order to do this, a vane angle of the fixed swirl vane of the radial swirler 83 needs to be increased. However, in this case, an axial vane height needs to be increased at the same time in order to secure a passage area of the pre-mixed gas P, and an entrance height of the radial swirler 83 also increases. With this, an axial size of an entrance portion to which the air and the fuel are introduced also increases.

In the conventional combustion device 80, in order to reduce the device size, an air passage 86 extending from a gas turbine compressor is formed between the combustion liner 81 and a housing H covering the outer side of the combustion liner 81, and the air A is introduced in a direction from a downstream end of the combustion liner 81 toward the top portion 81*a* that is an upstream end of the combustion liner 81, that is, in a direction opposite to the flow of the combustion gas. In this case, the air A having flowed through the air passage 86 is introduced to a premix passage through an entrance of the radial swirler 83 which opens in a radially outward direction, mixed with the fuel, and injected as the pre-mixed gas into the combustion liner in a direction opposite to the flow of compressed air.

To be specific, the flow direction of the air A introduced through the air passage 86 to the radial swirler 83 is changed by substantially 90°. Therefore, by a centrifugal force generated by the above direction change, an axial flow rate distribution of the air at an upstream portion of the premix passage is biased. Moreover, in the case of stabilizing the flame holding by increasing the vane angle of the swirl vane of the radial swirler as described above, the axial size of the entrance portion increases, so that the flow rate distribution is biased further significantly. As a result, a radial fuel concentration distribution of the pre-mixed gas injected through the premix passage into the combustion chamber is also biased. Therefore, the problem is that it is difficult to perform control operations, such as uniformizing the radial fuel concentration distribution and realizing the intended fuel concentration distribution.

An object of the present invention is to provide a combustion device capable of easily controlling the radial concentration distribution of the pre-mixed gas injected from the burner into the combustion chamber while stabilizing the flame holding by maintaining the large vane angle of the swirl vane of the radial swirler to generate the strong reverse flow in the combustion chamber, and a method for controlling the combustion device to easily control the radial fuel concentration distribution of the pre-mixed gas in the combustion device.

Solution to Problem

To achieve the above object, a combustion device according to the present invention includes: a combustion liner in which a combustion chamber is formed; a main burner provided at a top portion of the combustion liner and including a premix passage configured to annularly inject a pre-mixed gas of a fuel and air into the combustion chamber and a radial swirler configured to introduce the fuel and the air to the premix passage in a radially inward direction; and a fuel injection pipe configured to inject the fuel to the radial swirler from an entrance side of the radial swirler, wherein the radial swirler is divided into a plurality of swirler stages by dividing plates in an axial direction.

In accordance with this configuration, since the radial swirler is divided into a plurality of swirler stages by the dividing plates in the axial direction, the flow rate of the air introduced to the radial swirler can be prevented from being biased in the axial direction.

It is preferable that in the above combustion device, the fuel injection pipe include a plurality of fuel injection openings respectively corresponding to the swirler stages. In accordance with this configuration, since the fuel injection pipe configured to inject the fuel to the radial swirler includes the injection openings respectively corresponding to the swirler stages, the bias of the radial fuel concentration distribution of the pre-mixed gas injected from the premix passage into the combustion chamber can be significantly prevented.

In the above combustion device, a flow rate of the fuel supplied from the fuel injection pipe may be able to be set for each of the swirler stages. In accordance with this configuration, control operations become easy. For example, the radial fuel concentration distribution of the pre-mixed gas injected through the premix passage into the combustion chamber can be further uniformized, or the intended fuel concentration distribution can be realized.

As described above, in order to set the flow rate of the fuel for each of the swirler stages, for example, at least a part of the plurality of fuel injection openings of the fuel injection pipe may be different in inner diameter from one another. To be specific, the plurality of fuel injection openings may be configured to have individually set inner diameters. With this configuration, the radial fuel concentration distribution of the pre-mixed gas injected through the premix passage into the combustion chamber can be effectively controlled with a simple configuration.

In the combustion device according to the present invention, a radial length of the dividing plate may be shorter than that of a radially extending straight portion which forms an upstream portion of the premix passage. When the air having passed through the air passage changes its direction toward the radial swirler, it receives the highest centrifugal force at the entrance portion of the radial swirler. Therefore, the radial length may be a length capable of suppressing the axial bias of the flow rate of the air at this portion. In addition, shorter the radial length of the radial swirler is, longer the premix passage behind the radial swirler becomes. Therefore, the premixing is accelerated.

In the above combustion device, a method for controlling the combustion device according to the present invention includes the step of controlling a flow rate of the fuel supplied for each of the swirler stages to control a radial fuel concentration distribution of the pre-mixed gas injected from the main burner into the combustion chamber.

In the method for controlling the combustion device according to the present invention, since the axial flow rate distribution of the air is uniformized by dividing the radial swirler in the axial direction, the radial fuel concentration distribution of the pre-mixed gas injected into the combustion chamber can be easily controlled only by controlling the flow rates of the fuel supplied to respective swirler stages.

DESCRIPTION OF EMBODIMENTS

Figure 1:
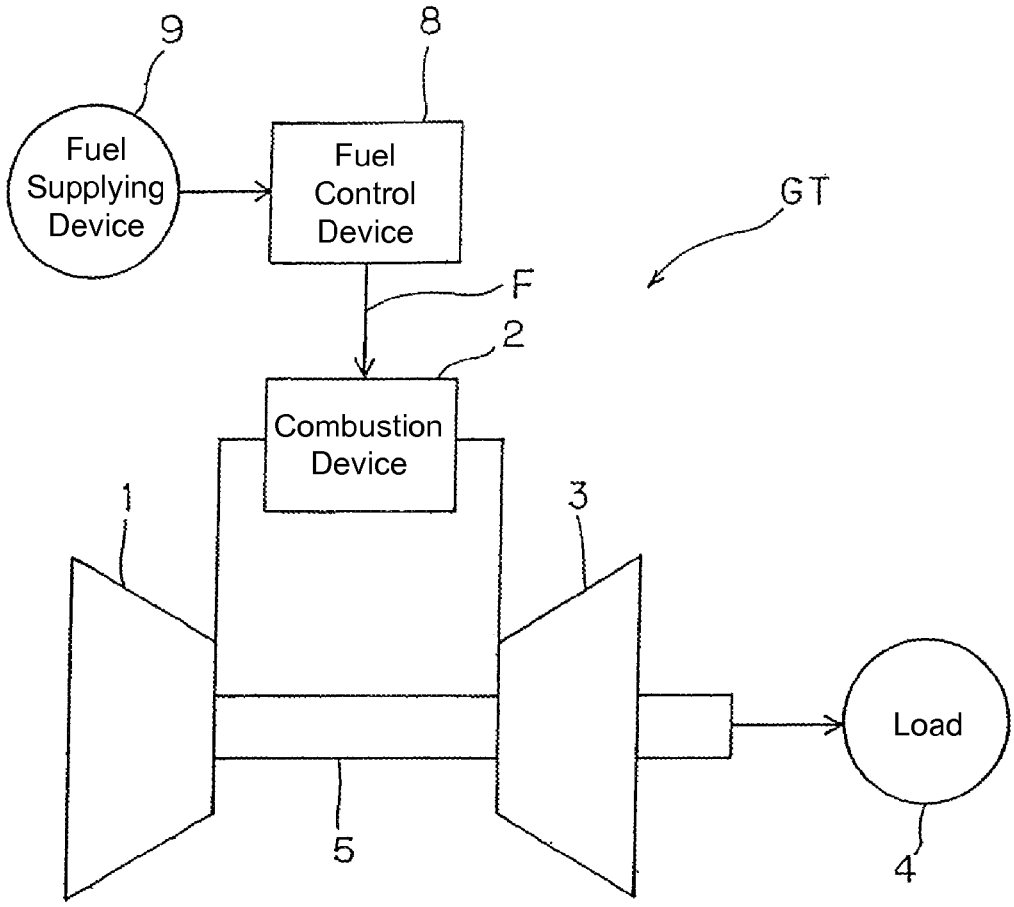
FIG. 1 is a schematic diagram showing a gas turbine engine to which a combustion device according to one embodiment of the present invention is applied.

Hereinafter, an embodiment according to the present invention will be explained in detail in reference to the drawings. FIG. 1 is a simplified configuration diagram showing a gas turbine engine to which a combustion device according to one embodiment of the present invention is applied. A gas turbine engine GT includes a compressor 1, a combustion device 2, and a turbine 3 as major components. Compressed air supplied from the compressor 1 is combusted in the combustion device 2, and a high-pressure combustion gas generated by this combustion is supplied to the turbine 3. The compressor 1 is coupled to the turbine 3 via a rotating shaft 5 and driven by the turbine 3. A load 4, such as a rotor of an aircraft or a power generator, is driven by an output of the gas turbine engine GT. A fuel F is supplied from a fuel supplying device 9 through a fuel control device 8 to the combustion device 2.

Figure 2:
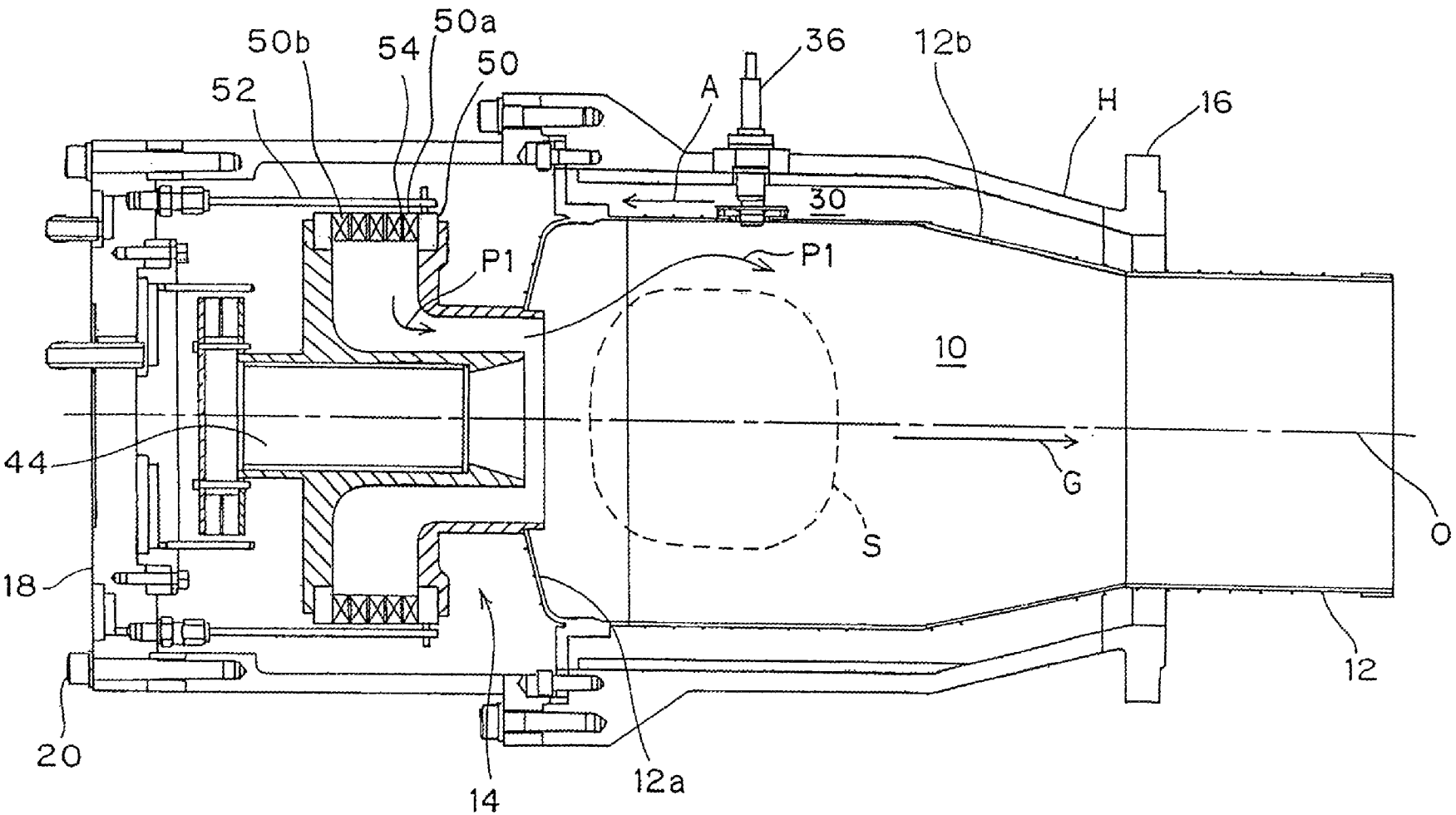
FIG. 2 is a cross-sectional view showing the combustion device of FIG. 1.

FIG. 2 is a cross-sectional view showing the combustion device 2. The combustion device 2 is a can type, that is, a plurality of combustion devices 2 are annularly arranged around an engine rotating axis line. The combustion device 2 includes a combustion liner 12 in which a combustion chamber 10 is formed and a burner unit 14 which is attached to a top portion 12*a* of the combustion liner 12 and injects a pre-mixed gas of the fuel and the air into the combustion chamber 10. The combustion liner 12 and the burner unit 14 are concentrically accommodated in a substantially cylindrical housing H that is an outer tube of the combustion device 2. An end cover 18 is fixed to a tip end of the housing H by bolts 20.

The combustion device 2 is a reverse flow type. An air passage 30 is formed between the housing H and a side wall 12*b* of the combustion liner 12. The air passage 30 introduces the compressed air A, supplied from the compressor 1, in a direction shown by an arrow toward the burner unit 14, that is, in a direction opposite to a flow direction of a fuel gas G in the combustion chamber 10.

At an upstream peripheral wall of the combustion liner 12, one or a plurality of spark plugs 36 are fixed to the housing H so as to penetrate the housing H and the combustion liner 12. The spark plug 36 ignites the pre-mixed gas injected from a below-described pilot burner 44 of the burner unit 14 to form a combustion region S at an upstream portion of the combustion liner 12. Moreover, a plurality of dilution air holes (not shown) are formed downstream of the combustion region S in the combustion liner 12 by causing short pipes to penetrate the housing H and the combustion liner 12.

Figure 3:
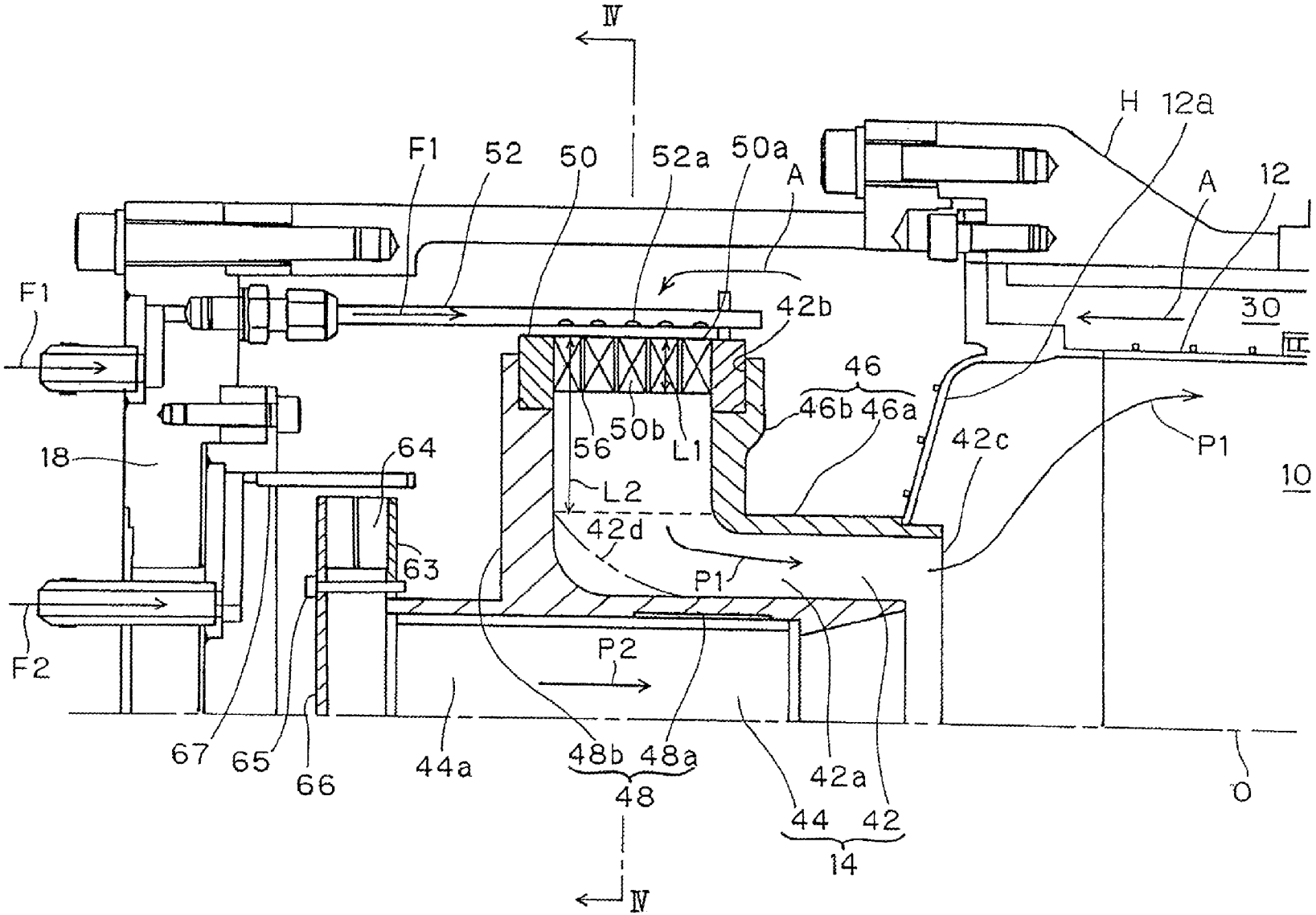
FIG. 3 is an enlarged cross-sectional view of main portions of the combustion device of FIG. 2.

FIG. 3 is a cross-sectional view showing main portions of the combustion device 2 of FIG. 2. The burner unit 14 includes a main burner 42 and the pilot burner 44. The main burner 42 injects an annular pre-mixed gas P1 containing swirling components, and the pilot burner 44 is provided inside the main burner 42. Specifically, the burner unit 14 includes a burner outer tube 46 and a burner inner tube 48. The burner outer tube 46 includes an outer-periphery cylindrical portion 46*a* concentric with an axis line O of the combustion liner 12 and an outer-periphery disc portion 46*b* extending in a disc shape from an upstream end of the outer-periphery cylindrical portion 46*a* in a direction perpendicular to the axis line O. The burner inner tube 48 includes an inner-periphery cylindrical portion 48*a* located on a radially inner side of the outer-periphery cylindrical portion 46*a* and an inner-periphery disc portion 48*b* located on an upstream side of the outer-periphery disc portion 46*b* and extending from the vicinity of an upstream end portion of the inner-periphery cylindrical portion 48*a* in parallel with the outer-periphery disc portion 46*b*. An annular first premix passage 42*a* of the main burner 42 is formed by a space between the burner outer tube 46 and the burner inner tube 48, and a second pre-mixed gas passage 44*a* of the pilot burner 44 is formed by an inner space of the burner inner tube 48.

The first premix passage 42*a* of the main burner 42 is formed to have an L shape in a vertical cross section passing through the axis line O (that is, a cross section that is a surface containing the axis line O). A radial swirler 50 is attached to an upstream portion of the first premix passage 42*a* which portion faces in a radially outward direction, that is, the radial swirler 50 is attached to between outermost peripheral portions of two disc portions 46*b* and 48*b*. A downstream portion of the first premix passage 42*a* faces in an axial direction. A radially outer end of the radial swirler 50 is formed as an entrance portion 50*a* through which the air A and a fuel F1 is introduced to the first premix passage 42*a* in a radially inward direction. A first fuel injection pipe 52 which forms a fuel passage through which the fuel F1 is supplied is provided on a further radially outward side of the entrance portion 50*a* so as to penetrate the end cover 18. A plurality of first fuel injection pipes 52 are arranged at regular intervals in a circumferential direction.

Figure 4:
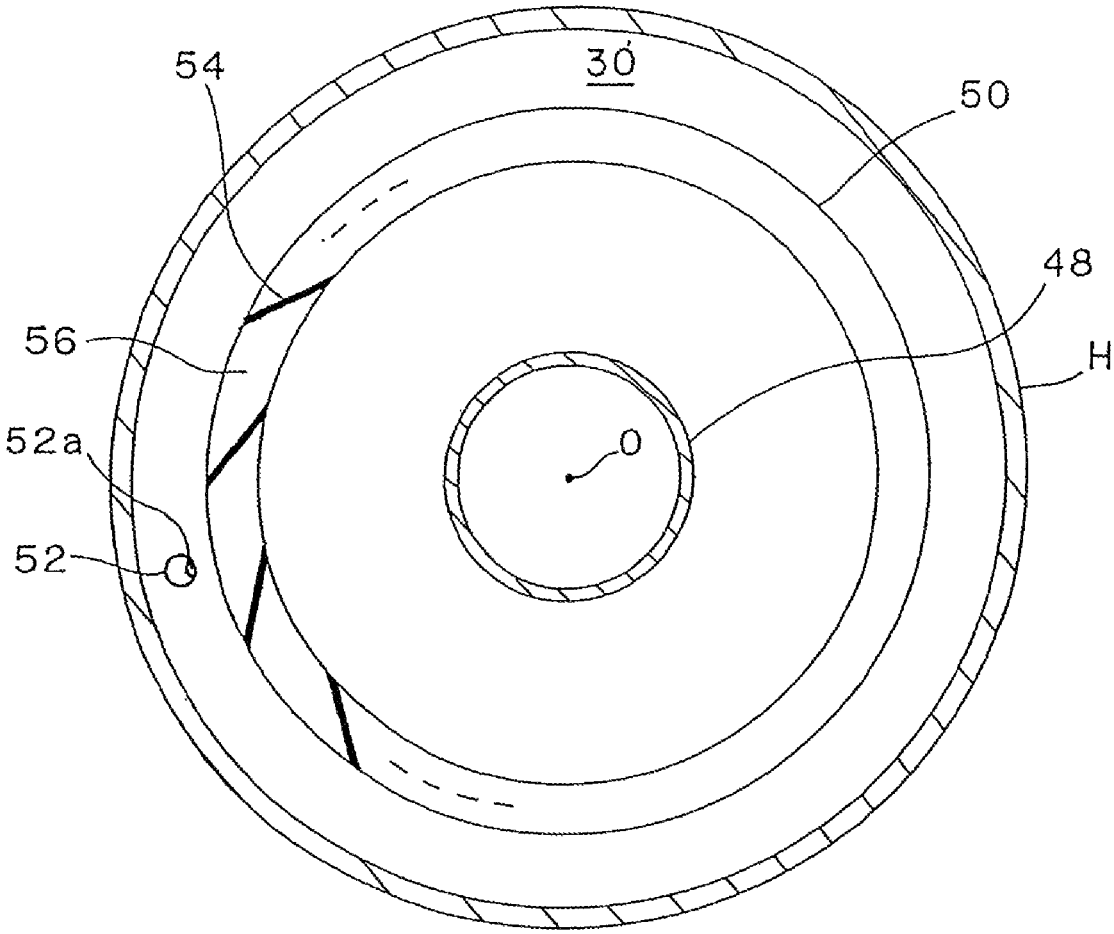
FIG. 4 is a cross-sectional view taken along line IV-IV of FIG. 3.

The radial swirler 50 is fixed to the main burner 42 by fitting in a fitting portion 42*b* formed between the outermost peripheral portions of two disc portions 46*b* and 48*b*. As shown in FIG. 4 that is a cross-sectional view taken along line IV-IV of FIG. 3, the radial swirler 50 includes fixed swirl vanes 54 configured to swirl the air A and the fuel F1 introduced to the first premix passage 42*a*. Further, the radial swirler 50 is provided with annular dividing plates 56.

As shown in FIG. 3, a plurality of swirler stages 50*b* are formed as swirler sections by dividing the radial swirler 50 by the dividing plates 56 along the axis line O. In the present embodiment, the radial swirler 50 is divided by four dividing plates 56 into five swirler stages 50*b*. Therefore, the entrance portion of the first premix passage 42*a* is also divided by the dividing plates 56 into five portions in the axial direction. Mixing proceeds in the first premix passage 42*a* and the pre-mixed gas P1 is generated by the swirling applied from the fixed swirl vanes 54 of the radial swirler 50. The pre-mixed gas P1 as a swirl flow around the axis line O of the combustion device 2 is injected into the combustion chamber 10 through an injection opening 42*c* that is a downstream opening of the first premix passage 42*a*. The number of dividing plates is not smaller than two and not larger than six, and preferably not smaller than three and not larger than 5. The swirler 50 may be divided into three to seven portions, and preferably four to six portions.

The dividing plate 56 may have such an adequate radial length that the compressed air A having flowed through the air passage 30 changes its direction to the radially inward direction to be introduced to the first premix passage 42*a*. A radial length L1 of the dividing plate 56, that is, a radial length of the radial swirler 50 is preferably in a range from ⅙ to ⅔ of a length L2 of an upstream radially straight portion of the first premix passage 42*a*, and more preferably ¼ to ½ of the length L2. In the present embodiment, the radial length L1 of the dividing plate 56 is set to ⅓ of the length L2 of the radially straight portion of the first premix passage 42*a*.

A ratio L1/D of the radial length L1 of the dividing plate 56 and an interval (that is an axial width of each swirler stage 50*b*) D between the adjacent dividing plates 56 along the axis line O is 2.0 in the present embodiment but is preferably 1.0 to 3.0, and more preferably 1.5 to 2.5. In a case where the ratio L1/D is lower than 1.0, the length L1 of the fixed swirl vane 54 is relatively short with respect to a large passage area (Circumferential Length of Entrance of Swirler×D). As a result, the effect of suppressing the bias of the axial air flow rate at each swirler stage 50*b* becomes small. In contrast, in a case where the ratio L1/D exceeds 3.0, an area (Circumferential Length of Dividing Plate 56×L1) of the dividing plate 56 is relatively large with respect to the large passage area of the swirler stage 50*b*. As a result, the frictional resistance of the air A by the dividing plate 56 increases.

The first fuel injection pipe 52 is provided with fuel injection openings 52*a* arranged in the axial direction. The number of fuel injection openings 52*a* is the same as that of the plurality of swirler stages 50*b*. The fuel injection openings 52*a* are provided so as to be respectively opposed to the swirler stages 50*b* on the entrance side. The fuel F1 is injected to the swirler stages 50*b* through the plurality of fuel injection openings 52*a*. In the present embodiment, inner diameters of the fuel injection opening 52*a* are the same as one another, and the flow rates of the fuel F1 injected to respective swirler stages 50*b* are set to be the same as one another.

An upstream portion of the second pre-mixed gas passage 44*a* is formed between an annular first passage plate 63 supported by the pilot burner 44 and a disc-shaped second passage plate 66 attached to the first passage plate 63 via a spacer 64 by a bolt 65 so as to be opposed to the first passage plate 63 in the axial direction. A second fuel injection pipe 67 configured to supply a fuel F2 is provided on a radially outward side of the upstream end of the second pre-mixed gas passage 44*a* so as to penetrate the end cover 18. The first fuel injection pipe 52 configured to supply the fuel F1 to the main burner 42 and the second fuel supplying passage 67 configured to supply the fuel F2 to the pilot burner 44 are provided as separate fuel supply systems. By individually controlling the fuel flow rate, the fuel concentration (air-fuel ratio) of the air-fuel mixture can be independently adjusted.

Next, the operation of the combustion device 2 configured as above will be explained.

As shown in FIG. 3, the compressed air A supplied from the compressor 1 flows through the air passage 30 that is a reverse-flow passage formed between the side wall 12*b* of the combustion liner 12 and the housing H. Then, the compressed air is introduced to the entrance portion 50*a* of the radial swirler 50 attached to the upstream portion of the first premix passage 42*a* of the main burner 42. The flow direction of the compressed air A is changed by 90° to the radially inward direction and is further changed by 90° when entering into the downstream portion of the first premix passage 42*a*. Therefore, the compressed air A receives a high centrifugal force when introduced to the radial swirler 50.

Figure 5A:
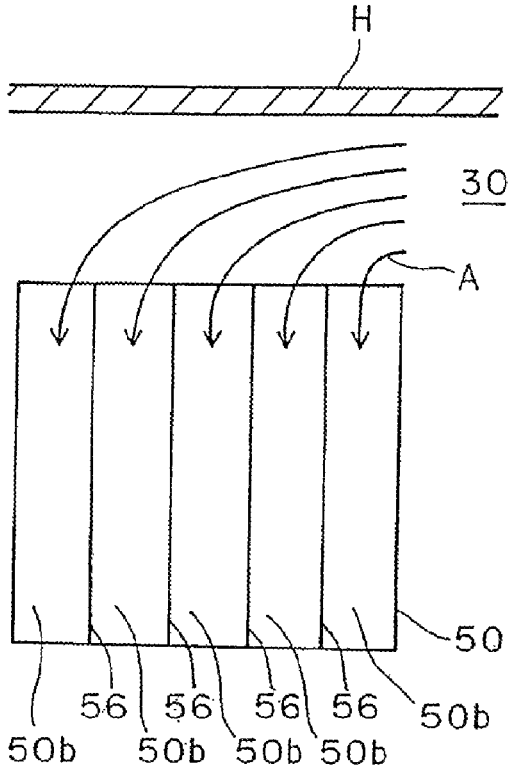
FIG. 5A is a schematic diagram for explaining the flow of air in the combustion device of FIG. 1.
Figure 5B:
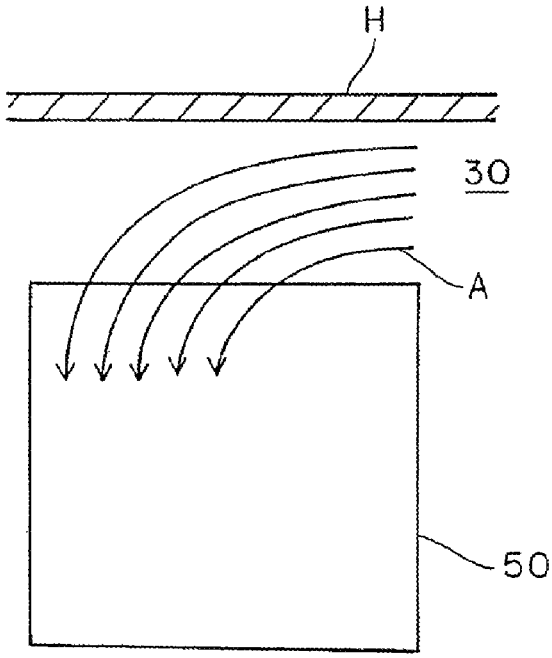
Fig. 5B (Prior Art)
FIG. 5B is a schematic diagram for explaining the flow of the air in a conventional combustion device.
Figure 6:
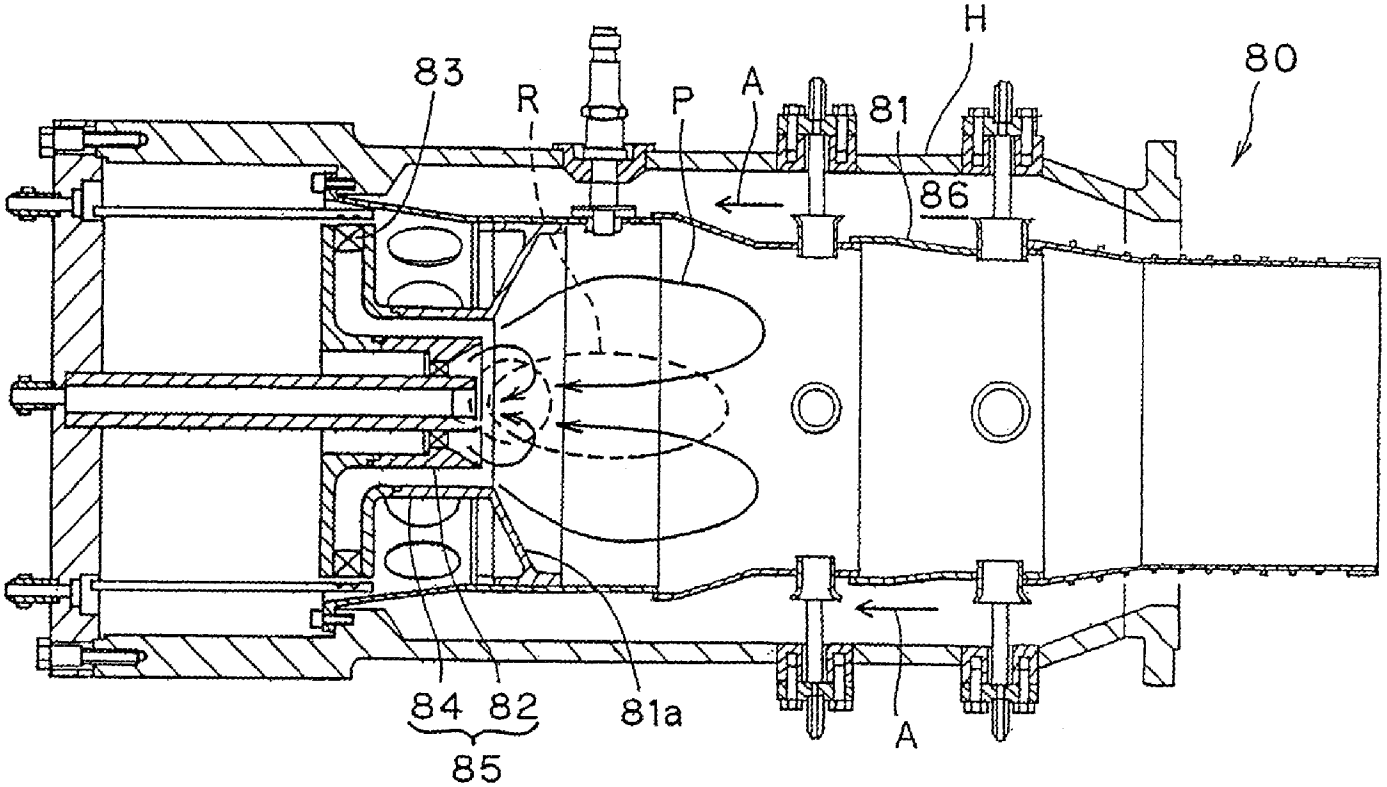
Fig. 6 (Prior Art)
FIG. 6 is a cross-sectional view showing the conventional combustion device.

In this case, in accordance with the conventional radial swirler 50 not including the dividing plates, as shown in FIG. 5B, the flow rate of the air A is biased by the influence of the centrifugal force so as to become high on an axial tip end side (on a left side in FIG. 5B). However, in accordance with the radial swirler 50 of the combustion device 2 according to the present embodiment, as shown in FIG. 5A, the air A is separately introduced to the plurality of swirler stages 50*b* formed by dividing the radial swirler 50 by the dividing plates 56 in the axial direction. Therefore, although the axial flow rates of the air A in respective swirler stages 50*b* are slightly biased, the bias of the axial flow rate of the air A in the entire radial swirler 50 is significantly prevented.

Further, since the fuel injection openings 52*a* provided to respectively correspond to the swirler stages 50*b* of FIG. 3 have the same inner diameter as one another, the flow rates of the fuel F1 injected to respective swirler stages 50*b* are controlled to be substantially the same as one another.

To be specific, in the radial swirler 50 used in the present embodiment, the flow rates of the air A introduced to respective swirler stages 50*b* formed by dividing the radial swirler 50 by the dividing plates 56 in the axial direction are controlled to be substantially the same as one another, and the flow rates of the fuel F1 introduced to respective swirler stages 50*b* are controlled to be substantially the same as one another. Therefore, the axial fuel concentration distribution of the pre-mixed gas P1 generated at the upstream portion of the first premix passage 42*a* is uniformized. As a result, the radial fuel concentration distribution of the pre-mixed gas P1 injected through the first premix passage 42*a* into the combustion chamber 10 can be uniformized.

Moreover, unlike the present embodiment, the inner diameters of the plurality of fuel injection openings 52*a* of the first fuel injection pipe 52 may not be the same as one another and may be individually set. To be specific, the inner diameters of the plurality of fuel injection openings 52*a* of the first fuel injection pipe 52 may be different from one another. The appropriate fuel concentration distribution of the pre-mixed gas P1 injected into the combustion chamber 10 in order to realize low NOx combustion may change depending on various factors, such as the shape of the combustion chamber 10 and the structure of the pilot burner 44 used in combination with the main burner 42. To be specific, there is a case where the fuel concentration of the pre-mixed gas P1 injected into the combustion chamber 10 should be controlled to be not necessarily uniform but intentionally biased.

Even in such case, in accordance with the combustion device 2 according to the present invention, since the axial flow rate distribution of the air A is uniformized by dividing the radial swirler 50 in the axial direction, the radial fuel concentration distribution of the pre-mixed gas P1 injected into the combustion chamber 10 can be easily controlled only by controlling the flow rates of the fuel F1 supplied to respective swirler stages 50*b*.

As described above, the flow rates of the fuel supplied to respective swirler stages 50*b* can be easily controlled by, for example, individually setting the inner diameters of the fuel injection openings 52*a* corresponding to respective swirler stages 50*b*.

Moreover, the swirler 50 divided into multiple stages in the axial direction can obtain an especially large effect in the case of the present embodiment. To be specific, in the combustion device 2, the air A introduced to the radial swirler 50 receives the high centrifugal force since the flow direction thereof is changed by 90° through the radial swirler 50. However, by providing the dividing plates 56 at the radial swirler 50, the bias of the axial flow rate distribution of the air A introduced to the radial swirler 50 can be suppressed at minimum. Therefore, while realizing a compact configuration of the combustion device 2, the radial fuel concentration distribution of the pre-mixed gas P1 in the combustion chamber 10 can be optimized, and the low NOx combustion can be realized.

In the present embodiment, as one example, the radial swirler 50 is divided into five swirler stages 50*b* by four dividing plates 56. However, the number of swirler stages 50*b* is not limited to five and may be suitably set.

Moreover, in the above embodiment, the fixed swirl vane 54 and dividing plate 56 of the radial swirler 50 have substantially the same radial length as each other. However, the fixed swirl vane 54 and the dividing plate 56 may have the different radial lengths from each other. Further, the swirler stages 50*b* may be different in the radial length and axial length from one another.

The shape of an internal corner portion 42*d* of the first pre-mixed gas passage 42*a* may be a circular-arc shape, which is like a part of an oval shape, as shown by a chain double-dashed line in FIG. 3, the internal corner portion 42*d* connecting the radially extending upstream portion and axially extending downstream portion of the first pre-mixed gas passage 42*a*. Moreover, in the above embodiment, the pilot burner 44 is explained as a burner configured to inject the pre-mixed gas P2 into the combustion chamber 10. However, the pilot burner 44 may be a diffusion combustion burner configured to separately inject the fuel F2 and the air A into the combustion chamber 10. Moreover, the above embodiment has explained an example in which the combustion device 2 is applied to the gas turbine engine GT. However, the combustion device according to the present invention can be applied to not only the gas turbine engine but also the other devices, such as a boiler, which require the supply of the high-temperature gas.

As above, the preferred embodiments have been explained in reference to the drawings. Various changes and modifications may be easily made by one skilled in the art within the scope of the present description. Therefore, such changes and modifications are within the scope of the present invention claimed in the claims.

The invention claimed is:

1. A combustion device comprising:

a combustion liner in which a combustion chamber is formed;

a main burner provided at a top portion of the combustion liner and including a premix passage configured to annularly inject a pre-mixed gas of a fuel and air into the combustion chamber and a radial swirler configured to introduce the fuel and the air to the premix passage in a radially inward direction;

a fuel injection pipe configured to inject the fuel to the radial swirler from an entrance side of the radial swirler; and wherein the premix passage includes a radially extending upstream portion and an axially extending downstream portion, the radial swirler includes swirl vanes and dividing plates which divide the swirl vanes into a plurality of swirler stages in an axial direction, and the radial swirler fits in the upstream portion of the premix passage.

2. The combustion device according to claim 1, further comprising a housing configured to accommodate the combustion liner, wherein an air passage configured to introduce the air in a direction opposite to a flow direction of a combustion gas in the combustion chamber is formed between the housing and a peripheral wall of the combustion liner.

3. The combustion device according to claim 1, wherein the fuel injection pipe includes a plurality of fuel injection openings respectively corresponding to the swirler stages.

4. The combustion device according to claim 3, wherein a flow rate of the fuel supplied from the fuel injection pipe is able to be set for each of the swirler stages.

5. The combustion device according to claim 4, wherein at least a part of the plurality of fuel injection openings of the fuel injection pipe are different in inner diameter from one another.

6. The combustion device according to claim 1, wherein a radial length of each dividing plate is shorter than that of a radially extending straight portion which forms the upstream portion of the premix passage.

7. A method for controlling a combustion device, the combustion device including: a combustion liner in which a combustion chamber is formed; a main burner provided at a top portion of the combustion liner and including a premix passage configured to annularly inject a pre-mixed gas of a fuel and air into the combustion chamber and a radial swirler configured to introduce the fuel and the air to the premix passage in a radially inward direction; and a fuel injection pipe configured to inject the fuel to the radial swirler from an entrance side of the radial swirler, the premix passage including a radially extending upstream portion and an axially extending downstream portion; the radial swirler including swirl stage in an axial direction; and the radial swirler fitting in the upstream portion of the premix passage;

the method comprising the step of controlling a flow rate of the fuel supplied for each of the swirler stages to control a radial fuel concentration distribution of the pre-mixed gas injected from the main burner into the combustion chamber.

* * * * *

UNITED STATES PATENT AND TRADEMARK OFFICE

CERTIFICATE OF CORRECTION

PATENT NO. : 8,555,650 B2
APPLICATION NO. : 12/993233
DATED : October 15, 2013
INVENTOR(S) : Hiroyuki Kashihara and Yasushi Yoshino It is certified that error appears in the above-identified patent and that said Letters Patent is hereby corrected as shown below:

In the Claims:

In Column 10, line 11, insert --s-- at the end of stage.

Signed and Sealed this
Twenty-eighth Day of January, 2014

Michelle K. Lee

Michelle K. Lee
*Deputy Director of the United States Patent and Trademark Office*